United States Patent [19]

Cook et al.

[11] Patent Number: 5,060,621

[45] Date of Patent: Oct. 29, 1991

[54] VAPOR PURGE CONTROL SYSTEM

[75] Inventors: Jeffrey A. Cook, Dearborn; Douglas R. Hamburg, Birmingham, both of Mich.

[73] Assignee: Ford Motor Company, Dearborn, Mich.

[21] Appl. No.: 399,192

[22] Filed: Aug. 28, 1989

[51] Int. Cl.[5] ..... F02M 33/02

[52] U.S. Cl. ..... 123/520; 123/516

[58] Field of Search ..... 123/518, 519, 520, 521, 123/516, 458

[56] References Cited

U.S. PATENT DOCUMENTS

| | | | |
|---|---|---|---|
| 3,886,920 | 6/1975 | Van Dusen, III et al. . | |
| 4,127,097 | 11/1978 | Takimoto . | |
| 4,308,842 | 1/1982 | Watanabe | 123/520 |
| 4,377,142 | 3/1983 | Otsuka | 123/520 |
| 4,527,532 | 7/1985 | Kasai et al. . | |
| 4,530,210 | 7/1985 | Yamazaki | 123/520 |
| 4,541,396 | 9/1985 | Sato et al. . | |
| 4,641,623 | 2/1987 | Hamburg | 123/520 |
| 4,700,683 | 10/1987 | Uranishi | 123/520 |
| 4,705,007 | 11/1987 | Plapp | 123/520 |

FOREIGN PATENT DOCUMENTS

| | | | |
|---|---|---|---|
| 0041957 | 2/1987 | Japan | 123/516 |
| 61-268861 | 11/1987 | Japan . | |
| 0205451 | 8/1988 | Japan | 123/519 |

*Primary Examiner*—Carl Stuart Miller

*Attorney, Agent, or Firm*—Allan J. Lippa; Peter Abolins

[57] ABSTRACT

A control system for engines equipped with both a fuel vapor recovery system and an air/fuel ratio feedback control system. The air/fuel ratio feedback control system regulates delivery of fuel in response to an exhaust gas oxygen sensor such that the mixture of air, fuel, and recovered fuel vapor approximates a desired air/fuel ratio. The fuel vapor recovery system includes two parallel solenoid valves which are phased controlled by a phase controller responsive to a measurement of inducted airflow such that total purge flow through both valves is proportional to inducted airflow.

11 Claims, 6 Drawing Sheets

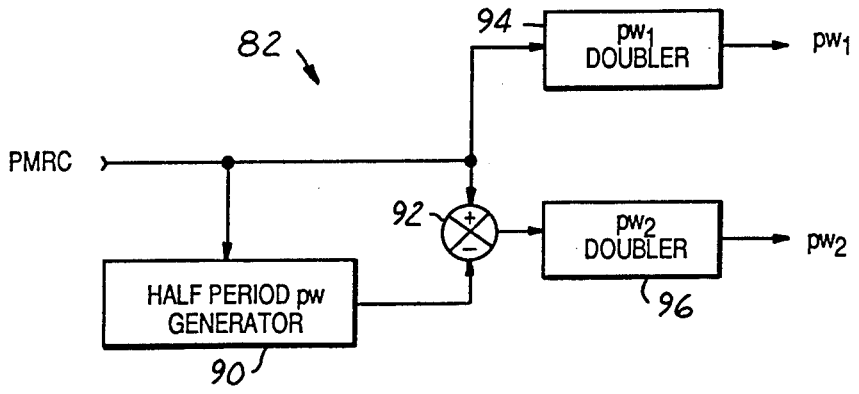
FIG.2A
FIG.2B
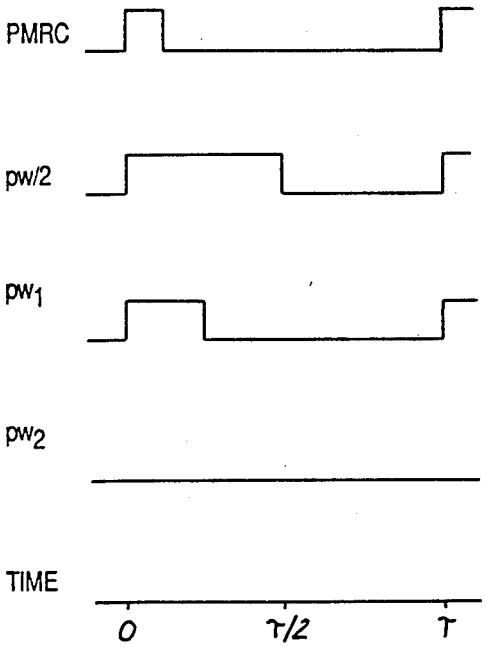
FIG.2C
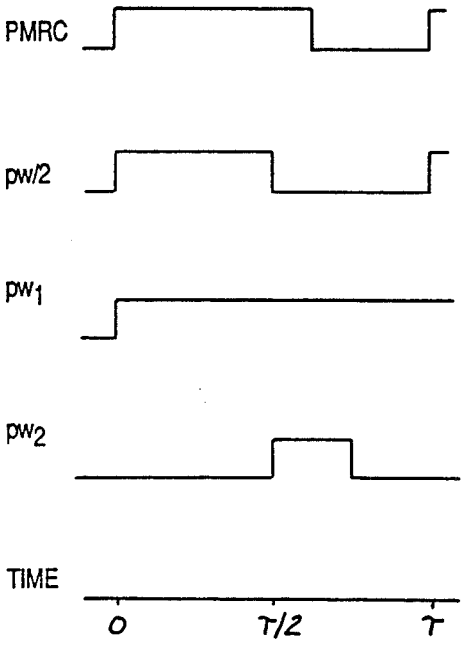

VAPOR PURGE CONTROL SYSTEM

BACKGROUND OF THE INVENTION

The field of the invention relates to fuel vapor recovery systems. In particular, the invention relates to control of fuel vapor recovery in engines equipped with air/fuel ratio feedback control systems.

Modern engines are equipped with three-way catalytic converters ($NO_x$, CO, and HC) to minimize emissions. Efficient operation requires that the engine's air/fuel ratio be maintained within an operating window of the catalytic converter. For a typical converter, the desired air/fuel ratio is referred to as stoichiometry which is typically 14.7 lbs. air/1 lb. fuel. During steady state engine operation, the desired air/fuel ratio is achievable by an air/fuel ratio feedback control system responsive to an exhaust gas oxygen sensor. More specifically, a desired fuel charge is first determined by dividing a measurement of inducted airflow by the desired air/fuel ratio. Electronically actuated fuel injectors are actuated in response to the desired fuel charge determination. This desired fuel charge is then trimmed by feedback from a correction factor responsive to the exhaust gas oxygen sensor such that actual engine operation is maintained near the desired air/fuel ratio.

Air/fuel ratio control has been complicated, and in some places made unachievable, by the addition of fuel vapor recovery systems. To reduce emission of gasoline vapors into the atmosphere, as required by federal emission standards, fuel vapor recovery systems are commonly utilized. These systems store fuel vapors emitted from the fuel tank in a canister having activated charcoal or other hydrocarbon absorbing material. During engine operation above a minimum speed and temperature, fuel vapors from both the fuel tank and storage canister are inducted into the engine. Induction of rich fuel vapors creates at least two types of problems for air/fuel ratio control. Since there is a time delay for air/fuel charge to propagate through the engine and exhaust, any perturbation in the air/fuel ratio of the inducted air/fuel charge results in an air/fuel transient. Thus, perturbing the inducted air/fuel charge by introducing purged fuel vapors may cause an air/fuel transient resulting in an emissions increase. Further, conventional air/fuel ratio feedback control systems have a range of authority. Induction of rich fuel vapors may exceed the feedback systems range of authority resulting in an unacceptable increase in emissions.

U.S. Pat. No. 4,715,340 issued to the same inventive entity as herein has addressed some of the above problems. More specifically, a combined air/fuel ratio feedback control system and vapor purge system is disclosed. To reduce the air/fuel transient which may occur during the beginning of a purge cycle, the rate of purge flow is controlled via a solenoid valve such that purge flow rate is ramped on at a slow rate. Further, the purge flow is made proportional to inducted airflow. In general, control of the purge flow is accomplished by duty cycle modulation of the "on time" of the solenoid valve. Stated another way, purge flow is proportional to the pulse width of a valve actuating signal. This pulse width is made proportional to inducted airflow.

The inventors herein have recognized that because the solenoid valve is sized for maximum purge flow, the valve is nonlinear, and may not turn on at all, at low purge flow rates. For example, at narrow pulse widths corresponding to low inducted airflow, the solenoid valve may not be actuated for a sufficient period of time to turn on. Thus, over the desired operating range, purge flow may not be maintained as a linear proportion of airflow, thereby causing an undesired air/fuel transient. This nonlinearity is becoming exacerbated with the increasing need to purge fuel vapors in view of tightening federal and state evaporative emission standards. It is becoming desirable to increase purge flow rates resulting in larger purge valves and accordingly more nonlinearity at low flow rates. Further, it is also becoming necessary to purge more often such as during light engine loads and idle. Both of these trends result in an exacerbation of the nonlinear disadvantages of prior approaches.

SUMMARY OF THE INVENTION

An object of the invention is to provide a fuel vapor recovery system having a controlled flow rate which is linear over a greater range than heretofore possible. The above object is achieved, and problems and disadvantages of prior approaches overcome, by providing both a control system and method for purging fuel vapors from a fuel system into an air/fuel intake of an internal combustion engine. In one particular aspect of the invention, the method comprises the steps of: regulating fuel delivered into the air/fuel intake system in response to a measurement of inducted airflow and feedback from an exhaust gas oxygen sensor to provide a desired air/fuel ratio; initiating the purging of fuel vapors in response to a measurement of engine operating parameters; determining a desired percentage of maximum purge flow which is substantially proportional to the measurement of inducted airflow; actuating in response to the purge initiating step a first electronically actuated valve connected between the fuel system and the air/fuel intake system with a first signal having a duty cycle twice the desired percentage when the desired percentage is below 50%, and providing the first signal with a 100% duty cycle when the desired percentage is above 50%; and actuating a second electronically actuated valve connected in parallel to the first valve with a second signal having a duty cycle which is twice the difference between the desired percentage and 50% when the desired percentage is above 50%, and a duty cycle which is zero when the desired percentage is below 50%.

By controlling the purge valves in the manner described above, the first valve will have twice as much time to open, and accordingly, will operate at one half the duty cycles or pulse widths which were possible with prior approaches. Further, the system is capable of providing twice the flow rate of prior approaches. An advantage is thereby obtained of having linear control of purge flow over a greater range than heretofore possible. More specifically, an advantage is obtained of having the purge flow be linearly proportional to airflow over a greater range than heretofore possible, thereby dramatically reducing any air/fuel transients caused by the onset of purging.

In another aspect of the invention, the control system comprises: air/fuel control means responsive to a measurement of inducted airflow and feedback from an exhaust gas oxygen sensor for regulating a mixture of air and fuel inducted into the engine; purge initiating means for purging fuel vapors into the engine in response to a measurement of engine operating parameters; flow determining means for determining a desired percentage of maximum purge flow which is substantially proportional to the measurement of inducted airflow; a first electronically actuated valve and a second electronically actuated valve connected in parallel between the fuel system and the engine for purging fuel vapors into the engine; actuating means responsive to the purge initiating means for actuating the first valve with a first signal having a duty cycle which is twice the desired percentage when the desired percentage is below 50% and a duty cycle which is at 100% when the desired percentage is above 50%; and actuating means for actuating the second valve with a second signal having a duty cycle which is twice the difference between the desired percentage and 50% when the desired percentage is above 50%.

An advantage obtained by the above aspect of the invention is linear control of purge flow over a greater range than heretofore possible. Accordingly, purge flow is linearly proportional to inducted airflow over an extended range, thereby dramatically reducing any air/fuel transients which would otherwise be induced at the onset of purging.

BRIEF DESCRIPTION OF THE DRAWINGS

The object and advantages of the invention described above and others will be more clearly understood by reading an example of an embodiment in which the invention is used to advantage with reference to the attached drawings wherein:

FIG. 2A is a block diagram of a portion of the embodiment shown in FIG. 1;

FIGS. 2B and 2C illustrates various waveforms associated with the portion of the embodiment shown in FIG. 2A;

DESCRIPTION OF THE PREFERRED EMBODIMENT

Figure 1:
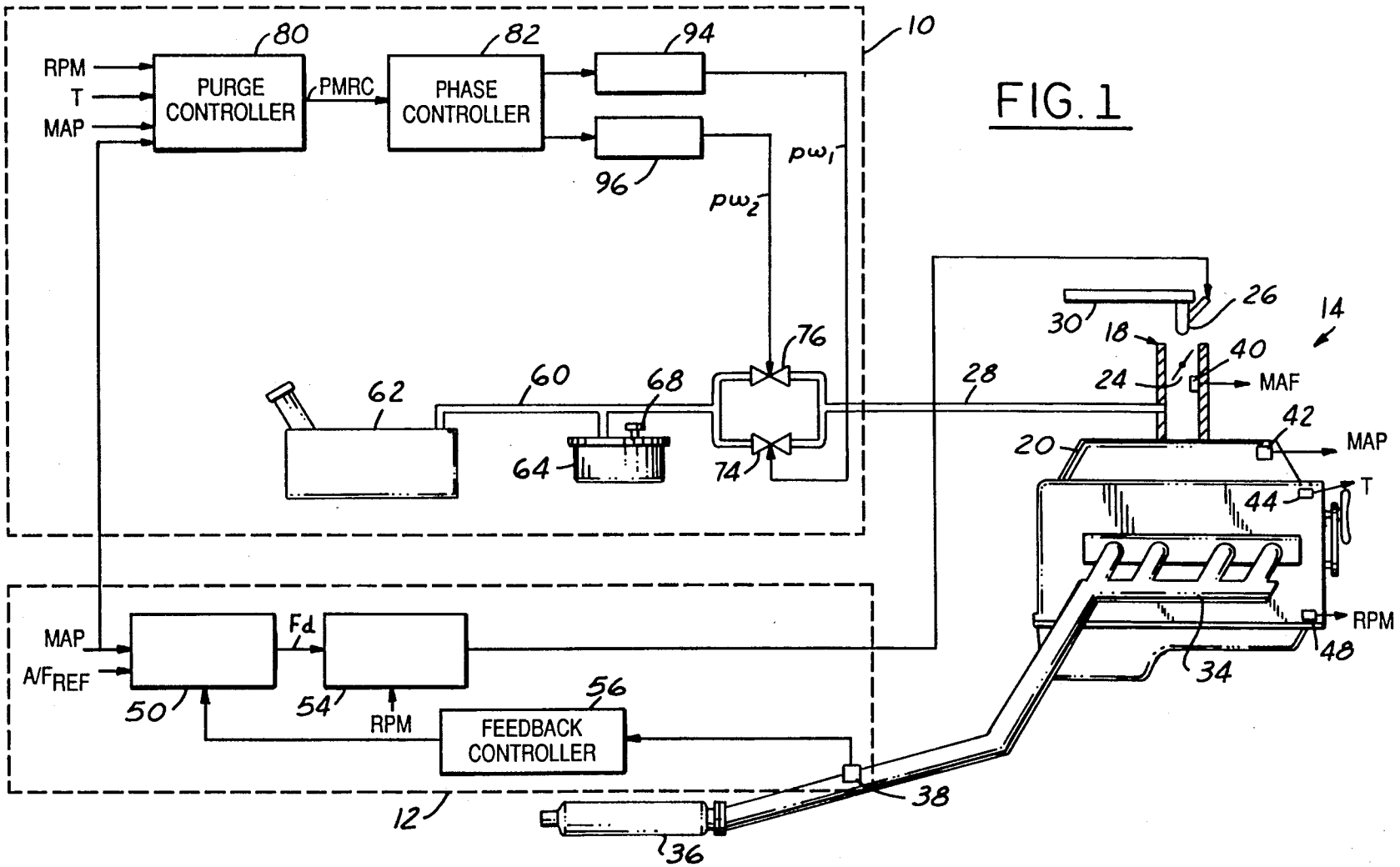
FIG. 1 is a block diagram of an embodiment wherein the invention is used to advantage.

The invention claimed herein will be better understood by reading an example of an embodiment utilizing the invention to advantage referred to herein as the preferred embodiment. Referring first to FIG. 1, a block diagram of vapor recovery system 10 and air/fuel (A/F) ratio feedback control system 12 are shown coupled to an internal combustion engine 14. In this particular example, engine 14 is shown as a central fuel injected engine having an air/fuel intake system which includes air/fuel intake 18 coupled to intake manifold 20. A/F intake 18 is shown having throttle plate 24 positioned therein and coupled to purge line 28 from fuel vapor recovery system 10. Electronically actuated fuel injector 26 is also shown coupled to A/F intake 18. A mixture of air, fuel, and fuel vapor is therefore inducted into the air/fuel intake system of engine 14.

Fuel injector 26 is shown coupled to fuel rail 30 for receiving pressurized fuel from a conventional fuel system (not shown). Engine 14 also includes exhaust manifold 34 and conventional three-way ($NO_x$, CO, HC,) catalytic converter 36. Exhaust gas oxygen sensor sensor 38 is shown coupled to exhaust manifold 34 for providing an indication of air/fuel ratio.

Conventional sensors are shown coupled to engine 14 for providing indications of engine operation. In this example, these sensors include mass airflow sensor 40 which provides a measurement of mass airflow (MAF) inducted into engine 14. Manifold pressure sensor 42 provides a measurement (MAP) of absolute manifold pressure in intake manifold 20. Temperature sensor 44 provides a measurement of engine operating temperature (T). Engine speed sensor 48 provides a measurement of engine speed (RPM) and crank angle.

A/F ratio feedback control system 12 is shown including desired fuel charge generator 50 for providing desired fuel charge signal (Fd) to conventional fuel controller 54 in response to signal MAF, air/fuel ratio reference ($A/F_{Ref}$) and correction factor $\lambda$ from feedback controller 56. Fuel controller 54 electronically actuates fuel injector 26 with a signal having a duty cycle proportional to signal Fd. In this example, feedback controller 56 is a proportional integral (PI) controller responsive to a rich/lean signal from EGO sensor 38 which indicates either a rich deviation or a lean deviation from $A/F_{Ref}$. Accordingly, correction factor $\lambda$ represents the offset or deviation in A/F ratio of engine 14 from $A/F_{Ref}$. For the example illustrated herein, $A/F_{Ref}$ is selected to be within the operating window of three-way catalytic converter 36. This value, referred to as stoichiometry, is 14.7 lbs. air/1 lb. fuel.

During open loop operation, desired fuel charge Fd is calculated by multiplying signal MAF by $(A/F_{Ref})^{-1}$. When feedback control is actuated, the above product is divided by correction factor $\lambda$. Thus, the fuel delivered to engine 14 is adjusted such that the mixture of air, fuel, and purged fuel vapor combusted in engine 14 results in an average A/F ratio of $A/F_{Ref}$. However, before a perturbation in A/F ratio can be corrected, a time delay is incurred due to propagation of an air/fuel charge through engine 14, exhaust manifold 34, EGO sensor 38, and PI feedback controller 56. Thus, rapid changes in fuel vapor purging would result in an air/fuel transient unless further compensation is provided as described herein. Further, A/F control system 12, like any feedback control system, has a limited range of authority. Stated another way, correction factor $\lambda$ is limited in maximum value. Thus, sudden changes in fuel vapor purging may exceed the range of authority of A/F ratio feedback control system 12 resulting in undesired operation. These potential problems are avoided by the operation of fuel vapor recovery system 10 described below.

Continuing with FIG. 1, fuel vapor recovery system 10 is shown including vapor purge line 60 coupled to both fuel tank 62 and vapor storage canister 64. In this example, vapor storage canister 64 is a carbon storage canister having atmospheric vent 68 for adsorbing hydrocarbons which would otherwise be emitted into the atmosphere. Solenoid actuated valves 74 and 76 are shown connected in parallel between purge line 60 and purge line 28 for controlling the rate of purge flow into air intake 18. In general terms which are described in greater detail later herein, valves 74 and 76 are actuated with an on time proportional to the pulse width of respective signals $pw_1$ and $pw_2$.

Purge controller 80 actuates a purge cycle in response to various engine parameters such as temperature (T) and engine speed (RPM). For the embodiment described herein, vapor purge is actuated at engine coolant temperatures above approximately 150° F. and engine speeds above approximately 600 RPM. Thus, unlike prior approaches, vapor purge may occur during idle and light engine load conditions. During a vapor purge, purge controller 80 generates a command signal (PMRC) related to the desired percentage of maximum purge flow rate. Signal PMRC is generated to be linearly proportional to the measurement of inducted airflow (MAF). Since purge flow is thereby made proportional to airflow, the induction of purged fuel vapors will not likely exceed the authority of A/F ratio feedback control system 12, and any resulting A/F transients should be minimal.

Phase controller 82 is now described with continuing reference to FIG. 1, and reference to FIGS. 2A, 2B, and 2C. In response to the leading edge of command signal PMRC, half period pw generator 90 generates signal pw/2 having a pulse width equal to one-half the period of signal PMRC. Signal pw/2 is subtracted from signal PMRC in subtracter 92 to generate a difference for actuating $pw_2$ doubler 96. In this example, $pw_2$ doubler 96 is responsive only to positive differences. Concurrently, signal PMRC actuates $pw_1$ doubler 94.

An example of operation of phase controller 82 is shown in FIG. 2B wherein the pulse width of signal PMRC is less than pw/2, and another example shown in FIG. 2C wherein the pulse width of signal PMRC is greater than pw/2. For the example shown in FIG. 2B, $pw_1$ doubler 94 generates signal $pw_1$ having a pulse width equal to twice the pulse width of PMRC. $Pw_2$ doubler generates signal $pw_2$ having a zero state. Thus, valve 74 is actuated with a duty cycle of twice PMRC while valve 76 is kept off. For the example shown in FIG. 2C, $pw_1$ doubler 94 generates signal $pw_1$ in the high state. $Pw_2$ doubler generates signal $pw_2$ having a pulse width equal to twice the difference between signal PMRC and signal pw/2 Thus, valve 74 is continuously activated while valve 76 is actuated with a duty cycle of twice the difference between PMRC and $pw_2$.

Figure 3:
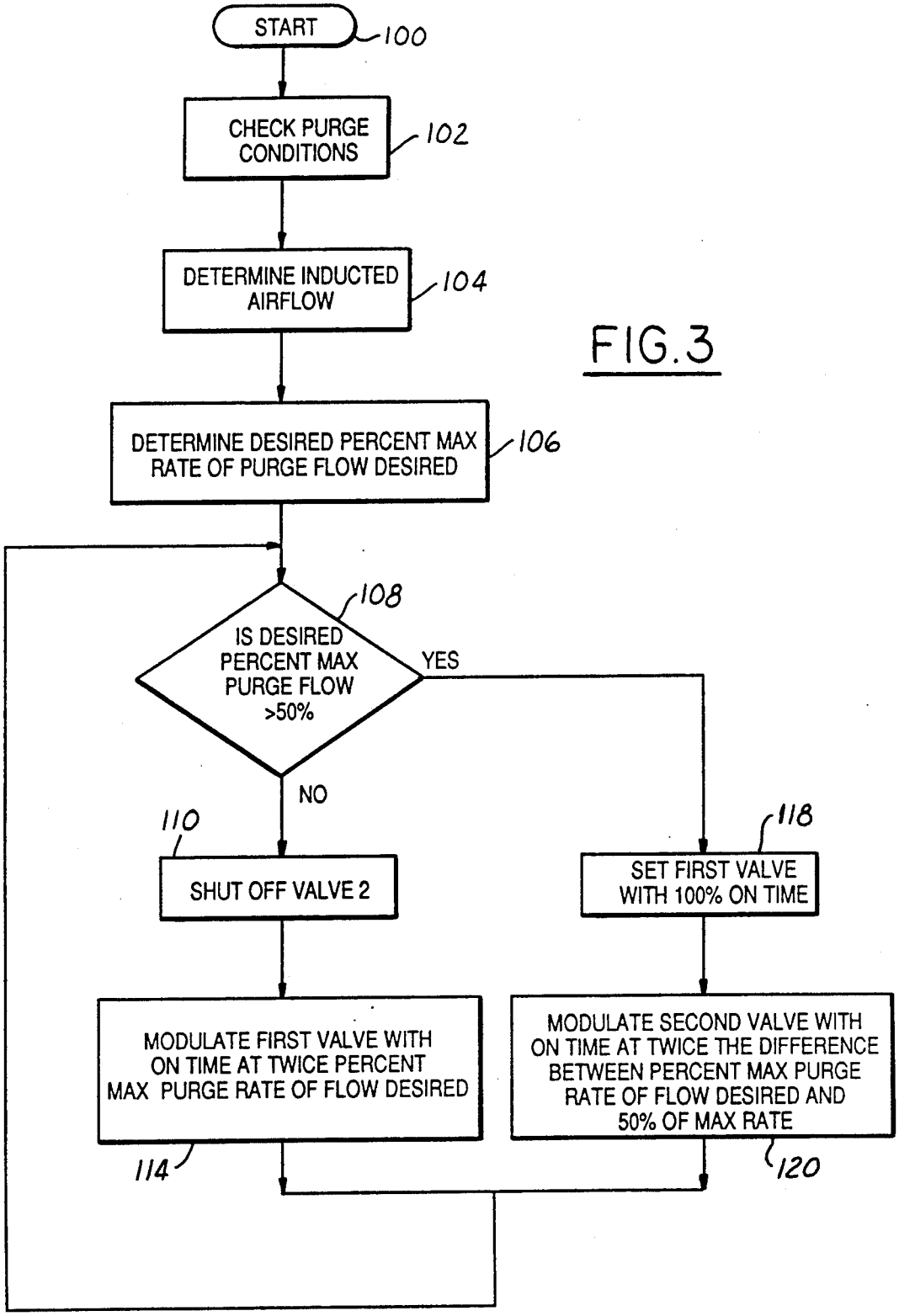
FIG. 3 shows a flowchart of process steps performed by a portion of the embodiment shown in FIG. 1.
Figure 4A:
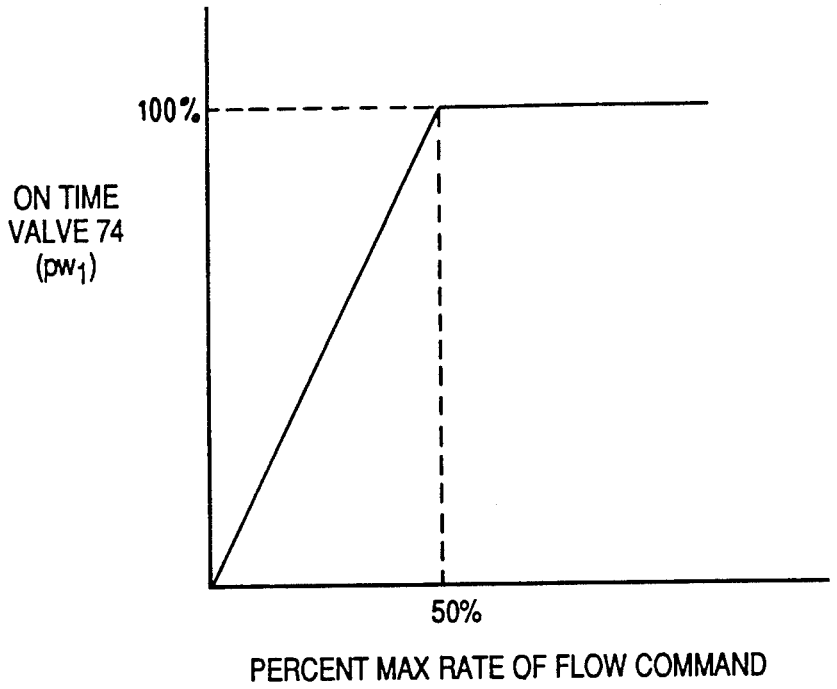
FIGS. 4A and 4B are graphical illustrations of a portion of the process steps shown in FIG. 3.
Figure 4B:
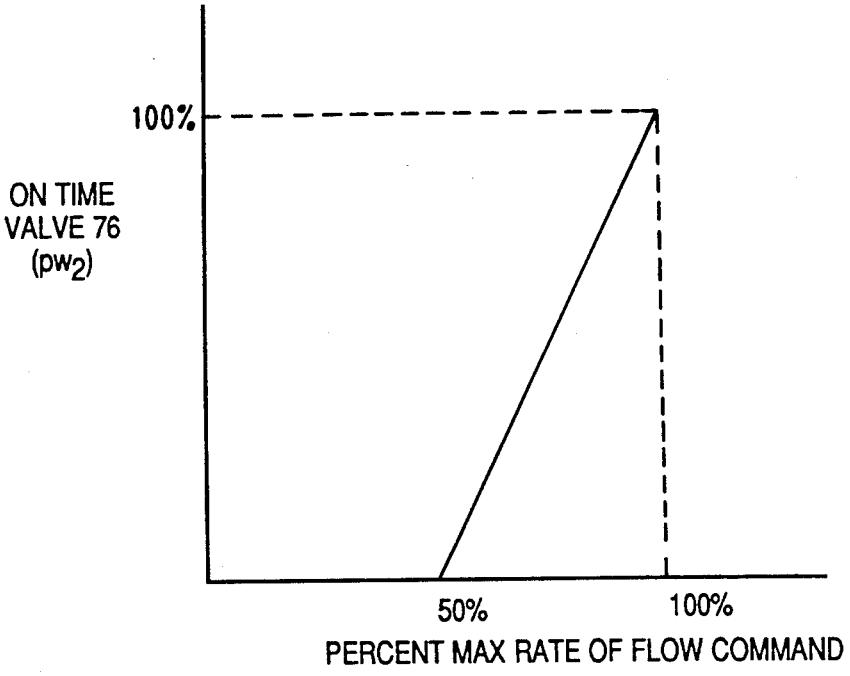

The operation of fuel vapor recovery system 10 is now described with reference to the process steps shown in FIG. 3 and the associated waveforms shown in FIGS. 4A, 4B and 5A–D. Purge conditions are first checked such as engine RPM and temperature (step 102). Inducted airflow is then measured (MAF) as shown in step 104. During step 106, a determination of the desired percentage of the maximum rate of purge flow is determined such that purge flow will be made proportional to inducted airflow. If the desired percent maximum purge flow is less than 50% (see step 108), valve 74 is modulated with an on time at twice the desired percentage of maximum purge flow rate (see step 114) and valve 76 is shut off (see step 110). If the desired percentage of maximum purge flow is greater than 50%, valve 74 is set fully on (see step 118), and valve 76 is modulated with an on time of twice the difference between the percent maximum rate of purge flow desired and 50% of the maximum rate (see step 120). Plotts of the on times of valves 74 and 76 as a function of the percent maximum rate of flow command are shown in FIGS. 4A and 4B.

Figure 5A:
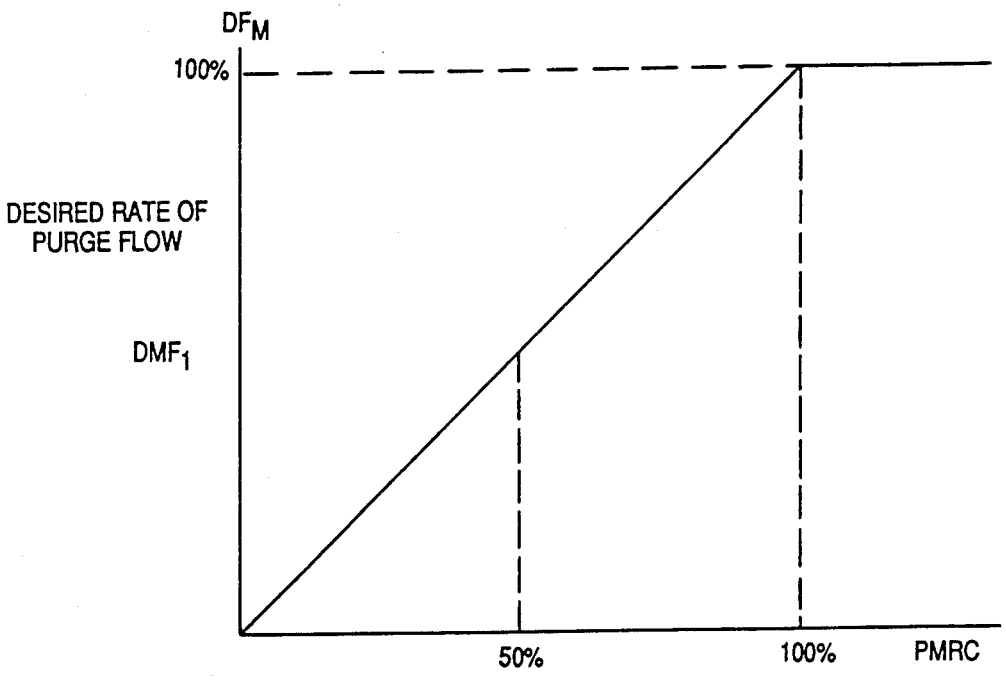
FIG. 5A, 5B, 5C, and 5D are graphical illustrations of the operation of a portion of the embodiment shown in FIG. 1.
Figure 5B:
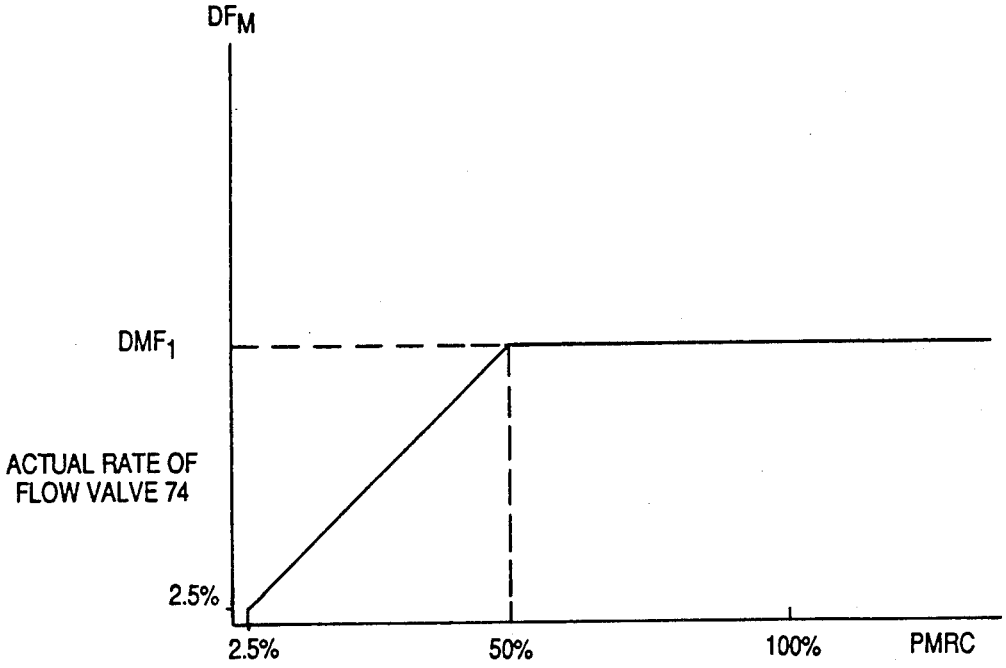
Figure 5C:
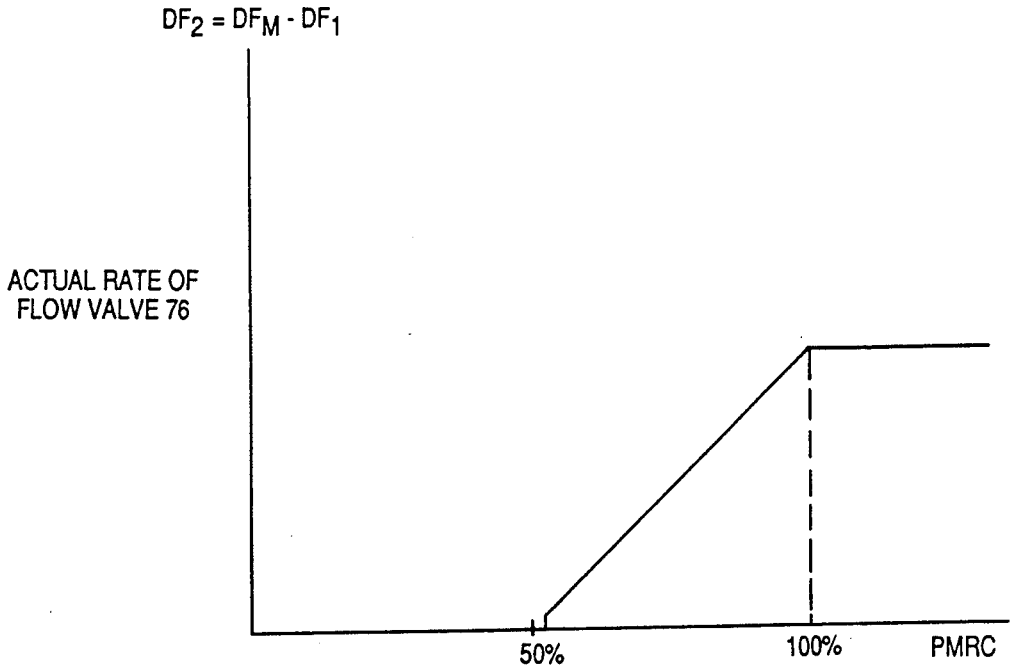
Figure 5D:
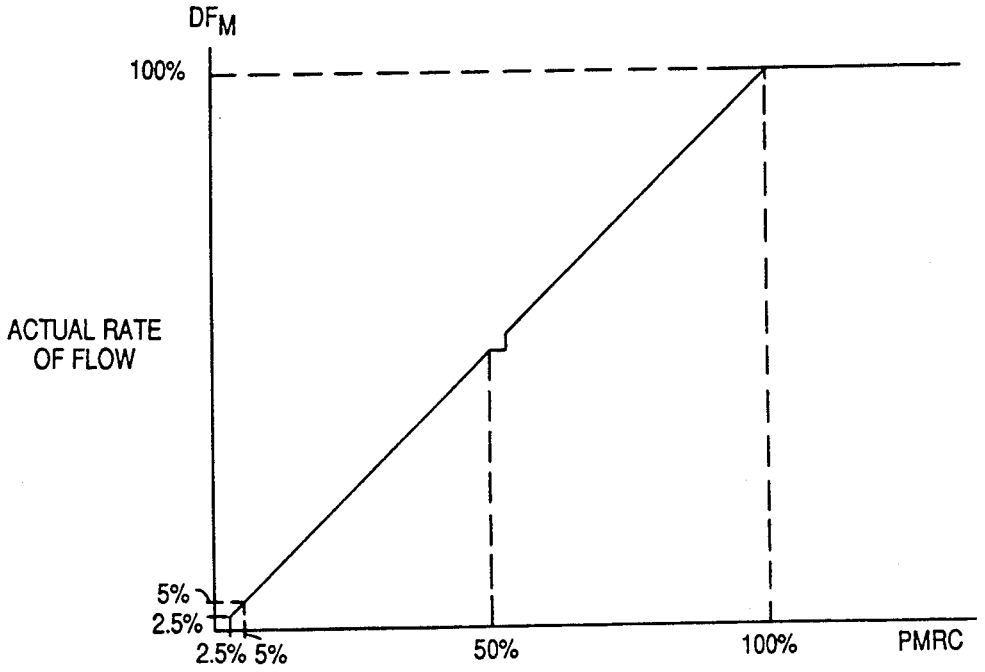

Referring to FIG. 5A, a graph of desired purge flow is shown as a function of signal PMRC. It is seen that maximum desired flow ($DF_M$) is achieved at a 100% duty cycle of PMRC. A 50% duty cycle of PMRC is shown corresponding to a desired flow of $DMF_1$. The actual flow through valve 74 is shown as a function of signal PMRC in FIG. 5B. Referring to FIG. 5C, the actual flow of valve 76 is shown commencing at a 50% duty cycle of PMRC. Referring now to FIG. 5D, the purge flow through purge line 28 is shown as the combination of actual flow through valves 74 and 76. It is noted that when signal PMRC is less than approximately a 2.5% duty cycle, insufficient time is allowed for valve 74 to turn on. It is further noted that a 2.5% duty cycle of signal PMRC corresponds to a 5% duty cycle of signal $pw_1$ due to the pulse width doubling operation previously described herein. Stated another way, solenoid valves are allowed twice the turn on time of prior approaches and therefore have an appreciable greater range of linearity.

This concludes the description of the preferred embodiment. The reading of it by those skilled in the art will bring to mind many alterations and modifications without departing from the spirit and scope of the invention. For example, the invention may be used to advantage with any multiple of parallel solenoid valves other than the two shown herein. Accordingly, it is intended that the scope of the invention be limited only by the following claims.

What is claimed:

1. A method for purging fuel vapors from a fuel system into an internal combustion engine, comprising the steps of:

determining a desired percentage of maximum purge flow;

actuating a first electronically actuated valve connected between said fuel system and said engine with an on time proportional to said desired percentage when said desired percentage is below a predetermined value and fully actuating said first valve when said desired percentage is above said predetermined value; and actuating a second electronically actuated valve connected in parallel to said first valve with an on time proportional to the difference between the said desired percentage and the said predetermined value when said desired percentage is above said predetermined value.

2. The method recited in claim 1 wherein said step of actuating said second valve commences when said desired percentage is above 50%.

3. The method recited in claim 1 wherein said step of actuating said first valve with an on time proportional to said desired percentage further comprises the step of actuating said first valve with an on time of twice said desired percentage.

4. The method recited in claim 1 further comprising the step of actuating a third electronically actuated valve connected in parallel with said first valve and said second valve with an on time proportional to the difference between the said desired percentage and a second predetermined value when said desired percentage is above said second predetermined value.

5. A method for purging fuel vapors from a fuel system into an air/fuel intake system of an internal combustion engine, comprising the steps of:

regulating fuel delivered into said air/fuel intake system in response to a measurement of inducted airflow and feedback from an exhaust gas oxygen sensor to provide a desired air/fuel ratio;

initiating the purging of fuel vapors in response to a measurement of engine operating parameters;

determining a desired percentage of maximum purge flow which is substantially proportional to said measurement of inducted airflow;

actuating in response to said purge initiating step a first electronically actuated valve connected between said fuel system and said air/fuel intake system with a first signal having a duty cycle of twice said desired percentage when said desired percentage is below 50% and providing said first signal with a 100% duty cycle when said desired percentage is above 50%; and actuating a second electronically actuated valve connected in parallel to first valve with a second signal having a duty cycle which is twice the difference between said desired percentage and 50% when said desired percentage is above 50%, and a duty cycle which is zero when said desired percentage is below 50%:

6. The method recited in claim 5 wherein said purge initiating step is responsive to a measure of engine temperature.

7. The method recited in claim 5 wherein said purge initiating step is response to a measurement of engine speed.

8. A vapor purge control system for purging fuel vapors from a fuel system into an internal combustion engine, comprising:

a first electronically actuated valve and a second electronically actuated valve connected in parallel between said fuel system and said engine for purging fuel vapors into said engine;

command means for determining a desired percentage of maximum purge flow; and control means for modulating said first valve with an on time proportional to said desired percentage when said desired percentage is below a predetermined percentage and modulating said second valve with an on time proportional to the difference between said desired percentage and said predetermined percentage when said desired percentage is above said predetermined percentage.

9. The vapor purge control system recited in claim 8 wherein said predetermined percentage is 50%.

10. The vapor purge control system recited in claim 8 wherein said control means modulates said first valve and said second valve with an on time which is twice said desired percentage.

11. A vapor purge control system for purging fuel vapors from a fuel system into an internal combustion, comprising:

air/fuel control means responsive to a measurement of inducted airflow and feedback from an exhaust gas oxygen sensor for regulating a mixture of air and fuel inducted into the engine;

purge initiating means for purging fuel vapors into the engine in response to a measurement of engine operating parameters;

flow determining means for determining a desired percentage of maximum purge flow which is substantially proportional to said measurement of inducted airflow;

a first electronically actuated valve and a second electronically actuated valve connected in parallel between said fuel system and said engine for purging fuel vapors into said engine;

actuating means responsive to said purge initiating means for actuating said first valve with a first signal having a duty cycle which is twice said desired percentage when said desired percentage is below 50% and a duty cycle which is at 100% when said desired percentage is above 50%; and actuating means for actuating said second valve with a second signal having a duty cycle which is twice the difference between said desired percentage and 50% when said desired percentage is above 50%.

* * * * *